US009962581B2

(12) United States Patent
Cordle

(10) Patent No.: US 9,962,581 B2
(45) Date of Patent: May 8, 2018

(54) GOLF CLUB

(71) Applicant: Delayed Strike Technology Ltd, Wiltshire (GB)

(72) Inventor: Robert William John Cordle, Wiltshire (GB)

(73) Assignee: DELAYED STRIKE TECHNOLOGY LTD., Wiltshire (GB)

( * ) Notice: Subject to any disclaimer, the term of this patent is extended or adjusted under 35 U.S.C. 154(b) by 12 days.

(21) Appl. No.: 14/763,443

(22) PCT Filed: Jan. 23, 2014

(86) PCT No.: PCT/GB2014/050180
§ 371 (c)(1),
(2) Date: Jul. 24, 2015

(87) PCT Pub. No.: WO2014/114940
PCT Pub. Date: Jul. 31, 2014

(65) Prior Publication Data

US 2015/0360090 A1 Dec. 17, 2015

(30) Foreign Application Priority Data

Jan. 24, 2013 (GB) ..... 1301254.7

(51) Int. Cl.
*A63B 53/02* (2015.01)
*A63B 53/04* (2015.01)
(Continued)

(52) U.S. Cl.
CPC ..... *A63B 53/04* (2013.01); *A63B 53/02* (2013.01); *A63B 69/3632* (2013.01);
(Continued)

(58) Field of Classification Search
CPC . A63B 2053/0441; A63B 60/46; A63B 60/52; A63B 69/3685; A63B 2053/022;
(Continued)

(56) References Cited

U.S. PATENT DOCUMENTS 1,603,850 A 10/1926 Keating
2,865,635 A 12/1958 Jessen
(Continued)

FOREIGN PATENT DOCUMENTS

GB 2 204 500 A 11/1988
JP 52146354 U 4/1951
(Continued)

*Primary Examiner* — Benjamin Layno
(74) *Attorney, Agent, or Firm* — Muncy, Geissler, Olds & Lowe, P.C.

(57) ABSTRACT

A golf club comprising an elongate shaft having a grip at a first longitudinal end thereof; a club head coupled to a second longitudinal end of the elongate shaft, the club head comprising a sole and a ball striking face; and, an elongate marker comprising a longitudinal axis orientated such that, when the sole of the golf club lies substantially parallel to the plane of the ground, the longitudinal axis of the elongate marker extends in a plane defined by a first vector in a direction substantially perpendicular to the plane of the ground and a second vector substantially parallel to a normal of the face of the club head. In use, the marker assists the player in optimizing the orientation of the golf club and, particularly but not exclusively, assists in achieving a "hands-ahead" position". Methods for adapting a golf club and manufacturing a golf club are also disclosed.

14 Claims, 5 Drawing Sheets

Figure 1A:
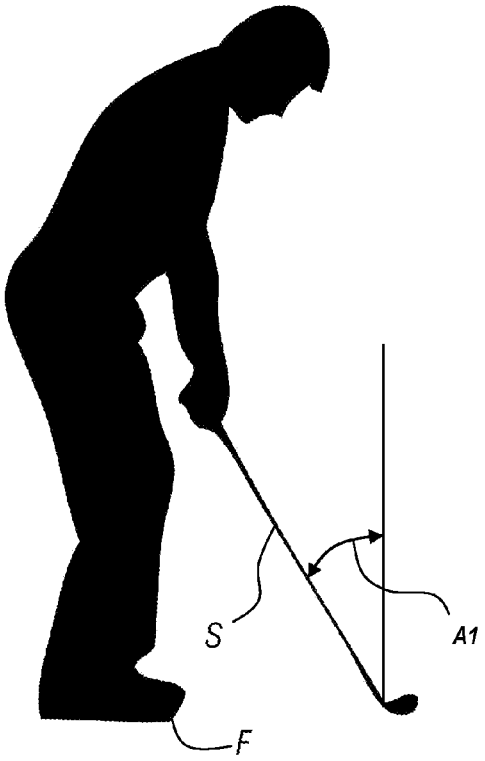

(51) Int. Cl.
*A63B 69/36* (2006.01)
*A63B 60/46* (2015.01)
*A63B 60/52* (2015.01)

(52) U.S. Cl.
CPC ..... *A63B 69/3685* (2013.01); *A63B 60/46* (2015.10); *A63B 60/52* (2015.10); *A63B 2053/022* (2013.01); *A63B 2053/025* (2013.01); *A63B 2053/026* (2013.01); *A63B 2053/027* (2013.01); *A63B 2053/0441* (2013.01); *Y10T 29/4989* (2015.01)

(58) Field of Classification Search
CPC ..... A63B 2053/025; A63B 203/026; A63B 2053/027005; A63B 2053/027
USPC ..... 473/231, 238, 242, 305, 314, 409
See application file for complete search history.

(56) References Cited

U.S. PATENT DOCUMENTS

| | | | | |
|---|---|---|---|---|
| 3,079,157 | A | 2/1963 | Turner | |
| 4,140,318 | A | 2/1979 | Izett et al. | |
| 4,157,830 | A | 6/1979 | Taylor et al. | |
| 4,222,567 | A | 9/1980 | Shabala | |
| 4,240,636 | A | 12/1980 | Swenson | |
| 4,753,440 | A | 6/1988 | Chorne | |
| 4,809,981 | A | 3/1989 | Doran et al. | |
| 4,852,879 | A * | 8/1989 | Collins ..... | A63B 53/0487 473/251 |
| 5,158,297 | A | 10/1992 | Johnson | |
| 5,209,474 | A | 5/1993 | Voyer | |
| 5,234,217 | A | 8/1993 | Johnson | |
| 5,308,068 | A | 5/1994 | Strand | |
| 5,348,295 | A | 9/1994 | Phillips | |
| 5,494,282 | A | 2/1996 | Pranio | |
| 5,709,612 | A | 1/1998 | Salado | |
| 6,780,118 | B1 * | 8/2004 | McCartney ..... | A63B 53/047 473/219 |
| 7,976,399 | B1 | 7/2011 | Pritchett | |
| 2001/0009872 | A1 | 7/2001 | Patsky | |
| 2002/0160849 | A1 * | 10/2002 | Thomas ..... | A63B 69/3685 473/251 |
| 2005/0075185 | A1 | 4/2005 | Green | |
| 2010/0041491 | A1 | 2/2010 | Thomas et al. | |

FOREIGN PATENT DOCUMENTS

| | | | |
|---|---|---|---|
| JP | 3006951 | U | 11/1994 |
| JP | H10192452 | A | 7/1998 |
| JP | H1133148 | A | 2/1999 |
| JP | H11-114104 | A | 4/1999 |
| JP | 2003-135628 | A | 5/2003 |
| JP | 2007-75278 | A | 3/2007 |
| WO | WO 94/09865 | A1 | 5/1994 |
| WO | WO 00/64543 | A1 | 11/2000 |
| WO | WO 01/74456 | A1 | 10/2001 |
| WO | WO 2006/136048 | A1 | 12/2006 |
| WO | WO 2007/106095 | A1 | 9/2007 |
| WO | WO 2009/035345 | A1 | 3/2009 |

* cited by examiner

GOLF CLUB

The invention relates to a golf club, golf clubs, a set of golf clubs and a training golf club.

In the game of golf the player is said to "address" the ball at set up and the set up is known as the address position. To play the ball, the player swings the club behind their upper back and uses a combination of a back swing and a down swing to bring the club head into contact (or "impact") with the ball.

For a given shot, a target line is defined between the golf ball and the target, for example the hole. There are two orthogonal angles of the shaft of a golf club that must be optimised in order to obtain the optimal shaft orientation: (i) the lean angle of the shaft relative to the vertical axis in a direction perpendicular to the target; and (ii) the lean angle of the shaft relative to the vertical axis in a direction parallel to the target line.

The first of the above-described angles is predominantly associated with the trajectory of the golf ball in the horizontal plane. The optimal angle is defined largely by the lie angle of the club. It will be appreciated that the term "lie angle" will be familiar to those skilled in the art. If lean angle of the shaft is too steep for the lie angle of the club i.e. too close to vertical then the toe of the club face may drag on the ground. This causes the club head to pivot and hence causes the plane of the face to tilt towards the right, thereby driving the ball in this direction. Conversely, if the lean angle of the shaft is too shallow for the lie angle of the club, the heel of the golf club may drag along the ground and cause the plane of the face to tilt towards the left.

The second of the above-described angles is predominantly associated with the launch angle of the golf ball, namely the angle of ascent of the golf ball immediately after impact. If the lean angle of the shaft is too steep i.e. too close to vertical then the ball will be directed upwardly and hence the distance of travel of the ball may suffer. Conversely, if the lean angle of the shaft is too shallow then the ball will travel close to the ground and may, for example, not achieve any flight at all. The optimal angle is defined largely by the loft angle and/or sole angle of the club. It will be appreciated that the terms "loft angle" and "sole angle" will be familiar to those skilled in the art.

It has been found that the centre of the club head arc in the golf swing is the player's lead shoulder not, as conventionally thought, be the centreline of the player's body. The main lever in the golf swing consists of the player's lead arm and the club shaft. Therefore the biomechanically optimised position to strike the golf ball is a position in which the main lever of the golf swing is aligned with the centre of the club head arc. This aligns the shaft with the lead shoulder; position in which the butt end of the club is approximately 15 cm towards the target.

It is often difficult for players to identify when this optimal impact position is achieved. A major reason for this difficulty is that the golf club is moving at high speed during impact and hence is only in the optimal position for a fraction of a second.

It has been found that the best golfers replicate or virtually replicate the orientation of the club at address at impact. In a conventional set up position, the shaft of the golf club is not aligned with the centre of the club head arc but the centreline of the player's body. This means the player has to perform additional complex movements during the backswing and downswing in order to lean the club shaft towards the centre of the club head arc and hence achieve an optimal impact position. This complicates the swing and forces the player to undertake these movements whilst the body is in motion. A complex swing such as this is difficult to achieve consistently.

I have realised that an effective way for a player to learn the correct impact position is to focus on the address position: assisting a player to identify the optimal position of the club at address will also assist the player in optimally positioning the club at impact.

In accordance with the present invention, as seen from a first aspect there is provided a golf club comprising:

- an elongate shaft having a grip at a first longitudinal end thereof;
- a club head coupled to a second longitudinal end of the elongate shaft, the club head comprising a sole and a ball striking face; and,
- an elongate marker comprising a longitudinal axis orientated such that, when the sole of the golf club lies substantially parallel to the plane of the ground, the longitudinal axis of the elongate marker extends in a plane defined by a first vector in a direction substantially perpendicular to the plane of the ground and a second vector substantially parallel to a normal of the face of the club head.

As used herein, a plane defined by first and second vectors is a plane in which both the first and second vectors lie. In other words, the normal to the plane is found by taking the vector cross product of the first and second vectors.

It will be appreciated that the present invention utilises the principle of triangulation to assist a golfer in optimising the position of the golf club.

The above-described golf club is configured to assist a player in optimising the first of the above-described angles, namely the angle of the shaft relative to said plane. It will be appreciated that this optimal angle is predominantly dictated by the lie angle of the club and will hence the orientation of the longitudinal marker relative to the shaft may vary substantially from club to club.

In addressing the ball, the player's line of sight is in a direction that lies in said plane. The above-described orientation of the marker is such that the player is able to recognise when the longitudinal axis of the marker also extends along said plane due to the apparent foreshortening of the marker in this position. In recognising that the longitudinal axis of the elongate marker extends in said plane, the player identifies the optimal lean angle of the shaft of the club relative to said plane. The pre-setting of the hands at address into a position that closely resembles an optimal impact position removes complex movements that are required when a player starts from a conventional set up position and tries to obtain an optimal impact position. This new set-up position also builds muscle memory of the position the player is trying to re-obtain at impact.

Preferably the longitudinal axis of the elongate marker is orientated such that, when a tangent to the mid-point of the sole intermediate the toe and heel lies substantially parallel to the plane of the ground, the longitudinal axis of the elongate marker extends in the plane defined by the first and second vectors.

The shaft of the golf club may be at an angle that is between 0 and 30 degrees to said plane when the longitudinal axis of the elongate marker lies in said plane. Preferably the shaft of the golf club is at an angle that is between 0 and 22 degrees to said plane when the longitudinal axis of the elongate marker lies in said plane.

Preferably the golf club is further configured to assist a player in optimising the second of the above-described angles at address, namely the angle of the shaft within said plane relative to the vertical direction. It has been found that the conventional set up position, in which the player's stance is symmetrical and the player sets the head of the golf club behind the ball ready to play, is not the same as the optimum impact position when impacting with and hitting the ball during play. The optimal position is in fact one in which the hands are ahead of the centre-line of the body, towards the direction of the target. This position is known as the "hands ahead" or "delayed strike" position. A position in which the distal end of the shaft at the grip end (also known as the butt end of the golf club) is approximately 15 cm from the centreline of the player's body, in the direction of the target, is generally considered optimal. It will be appreciated that this address position is different to the conventional address position, in which the butt end of the golf club is approximately aligned with the centreline of the player's body.

Preferably the golf club is configured to bias a player to a position in which the player's hands are displaced by approximately 10 to 15 cm from the centreline of the player's body, in the direction of the target.

The elongate marker is preferably orientated such that, when the sole of the golf club lies substantially parallel to the plane of the ground, the longitudinal axis of the elongate marker is substantially parallel to the player's line of sight. It will be appreciated that the marker will appear maximally foreshortened when in this orientation. The above-described orientation of the marker is therefore such that the player is able to recognise when the golf club is optimally positioned due to the apparent foreshortening of the marker in this position.

The optimal position of the centre-line of the player's body relative to the ball at address may vary according to the type of club. For example, the ball may be positioned equidistant between the lead foot and the centre-line of the player's body when the player is using a long to mid iron. The ball may be approximately aligned with the mid or the centre-line of the player's body, away from the target, when using a short iron. Conversely, the ball may be positioned adjacent the player's lead foot when using a driver, such that the golf club makes contact with the ball during the upswing. It will be appreciated that variations in the position of the ball relative to the centre-line of the body generates variations in the line of sight of the player at address and impact. It is therefore difficult to precisely define the direction of the player's line of sight. It will, however, be appreciated that the line of sight at address and impact is a line from a first location to a second location on the leading edge of the head of the golf club, the first location being between approximately 150 cm and 210 cm upwardly and up to approximately 15 cm leftwardly or rightwardly of the second location.

Preferably the longitudinal axis of the elongate marker is arranged to extend in a direction substantially parallel to the first vector when the second angle of the shaft is between approximately 3 degrees and approximately 30 degrees. More preferably, the longitudinal axis of the elongate marker is arranged to extend in a direction substantially parallel to the first vector when the second angle of the shaft of the golf club is between approximately 5 degrees and approximately 22 degrees.

The club head may be coupled to the second longitudinal end of the elongate shaft by a shaft connection member, which may comprise a hosel. Preferably the elongate marker is located at least partially on the shaft connection member. More preferably, the marker is located wholly on the shaft connection member. The elongate marker may be located on a leading side of the shaft connection member so that the marker is easily visible when the golf club is inclined to the vertical within said plane. A hosel or hosel extension is convenient for marking without damaging the club head and is within a player's eye line during set up or address.

The ball striking face may comprise a leading edge and a trailing edge, defined in terms of the direction of swing of the golf club. Preferably the longitudinal axis of the elongate marker is directed towards the leading edge of the ball striking face, more preferably directed towards a leading groove on the ball striking face, namely the groove closest to the target The ball striking face may be inclined at an angle relative to the sole of the golf club. The ball striking face is positioned with respect to the shaft at an angle in the range of 0 degrees to 65 degrees.

In an embodiment the striking face is planar. An iron has a flat or planar striking face. In another embodiment the striking face is convex. Woods and rescue type clubs have a convex striking face. The ball striking face may comprise a series of grooves or ridges.

The elongate marker may comprise a line.

The elongate marker preferably comprises a mark from the range of; painted, forged, milled, cast, scored, dyed and molded.

Preferably the golf head comprises a sole angle of at least 0 to 30 degrees, when the measurement is taken whilst the shaft centreline is in said plane. Advantageously, the player is directed towards the optimal address position due to a combination of the angle of the shaft and the enhanced sole angle of the club. The angle of the head has the effect of pushing the ball through to the target, whilst the elongate marker gives feedback and instruction to the player.

Preferably the sole of the golf club comprises a substantially planar portion. Advantageously, this assists the natural orientation of the club to a position in which the substantially planar portion lies flat on the ground.

The golf club may be a training club comprising a curved shaft. The shaft is preferably concave if viewed from above when in use. Preferably the shaft is configured to curve outwardly away from the direction of the target when in use. This can assist a player to become accustomed to the lateral body movement required to achieve an optimum impact position and hands ahead position and can be used as a coaching tool illustrating the forwards effective impact position required.

The curvature on the shaft imitates the shape of a conventional shaft when it is under full compression with the ball and ground. In this embodiment, due to the curved nature of the shaft, the club head is approximately 15 cm behind the straight line axis of the shaft at the butt end of the club. The combination of the curved shaft and the elongate marker encourages the player to lead his hands into a position in front of the line of tension before the clubface makes contact with the ball. As used herein, "line of tension" is defined as a reference line between the lead shoulder and the ball, the line of tension being perpendicular to the line of compression, which is well known in the art. The line of tension is important for maintaining contact with the ball to urge the ball forwards towards the target, rather than to swing the club in a pendulum swing path. Additionally and importantly, the hands have to hold the clubface square to the target line whilst the hands are in this forward leaning position until the ball has been struck. The curved shaft encourages the player to maintain the relationship between the lead arm and shaft for 15 cm in order to get the club head to make contact with the ball, whilst the hands are still holding the club face square to the target line. This movement prevents the player from rolling his hands over and releasing the club head too early. The club therefore forces the player to swing the club head down the target line for an elongated period of time during the impact area. Since the club head and face stay square to the target for a fraction longer, a greater degree of accuracy is achieved. This movement is called "Sustaining the line of Compression" or a "Delayed Strike or Lag Impact". A training club comprising a curved shaft therefore forces the player to feel the sensation of a delayed strike and all of the benefits that go with sustaining the line of compression.

In accordance with the present invention, as seen from a second aspect, there is provided a method for modifying a golf club to assist in training, the method comprising:

a) providing a golf club comprising a club head coupled to a longitudinal end of an elongate shaft, the club head comprising a sole and a substantially planar face;
b) aligning the sole of the golf club with a first plane;
c) marking the golf club with an elongate marker having a longitudinal axis in a plane comprising a first vector in a direction substantially perpendicular to the plane of the ground and a second vector substantially parallel to the normal of the face of the club head.

Step (b) may comprise aligning a tangent to a mid-point of the sole with said first plane. Alternatively or additionally, step (b) may comprise aligning a substantially planar portion of the sole of the golf club with said first plane.

Step (c) may comprise marking a shaft connection member configured to couple the second longitudinal end portion of the shaft with the club head.

It will be appreciated that a golf club in accordance with the present invention assists a player in obtaining the optimal lean angle of the shaft during address in a direction perpendicular to the target line, thereby assisting a player to avoid hooking or slicing the ball during the impact phase.

In a preferred embodiment, the marker may also be configured to assist the player in identifying the optical lean angle of the shaft in a direction parallel to the target line. In this embodiment, the method preferably further comprises identifying a line of sight of a player stood on said first plane and holding the club such that the sole is aligned with the first face. The method preferably further comprises positioning the player in an optimal address position. Step (c) may comprise marking the golf club with an elongate marker having a longitudinal axis substantially parallel to the player's line of sight to the head of the golf club when in said optimal address position.

The method may be implemented for an individual player, thereby providing a golf club that is specific to the body of that player. Alternatively, the method may be implemented for an "average" body, or a plurality of bodies of differing heights.

The elongate marker may be as hereinbefore described.

In accordance with the present invention, as seen from a third aspect, there is provided a method for manufacturing a golf club, the method comprising:

a) connecting a club head to a longitudinal end of an elongate shaft, the club head comprising a sole and a substantially planar face;
b) aligning the sole of the golf club with a first plane;
c) marking the golf club with an elongate marker having a longitudinal axis in a plane comprising a first vector in a direction substantially perpendicular to the plane of the ground and a second vector substantially parallel to the normal of the face of the club head.

Step (b) may comprise aligning a tangent to a mid-point of the sole with said first plane. Alternatively or additionally, step (b) may comprise aligning a substantially planar portion of the sole of the golf club with said first plane.

Step (c) may comprise marking a shaft connection member configured to couple the second longitudinal end portion of the shaft with the club head.

In a preferred embodiment, the marker may also be configured to assist the player in identifying the optical lean angle of the shaft in a direction parallel to the target line. In this embodiment, the method preferably further comprises identifying a line of sight of a player stood on said first plane and holding the club such that the sole is aligned with the first face. The method preferably further comprises positioning the player in an optimal address position. Step (c) may comprise marking the golf club with an elongate marker having a longitudinal axis substantially parallel to the player's line of sight to the head of the golf club when in said optimal address position.

The method may be implemented for an individual player, thereby providing a golf club that is specific to the body of that player. Alternatively, the method may be implemented for an "average" body, or a plurality of bodies of differing heights.

The elongate marker may be as hereinbefore described.

Examples of a golf club in accordance with an embodiment of the present invention, when in use, will now be described.

When striking a golf ball, a player moves laterally from the address position towards the target to which the player is aiming and into the impact position after completing the backswing and downswing. It can be said that the purpose of the backswing and downswing is twofold. Firstly, it achieves a forward momentum in the direction of the target by generating club head speed at impact and secondly the swing delivers the club head to the ball in a so called minutely open or square to target position at impact. The swing should also deliver the player and club to the ball with the optimum impact position: with weight predominantly on the lead foot, with hands ahead of the club head and thus creating a "Hands Ahead Angle" i.e. the angle generated between the centreline of the shaft at impact and a vertical line to the ground from the end of the butt end of the shaft. Most professionals would concur that the main purpose of the golf swing is to create a Hands Ahead Angle at impact, this is otherwise known as a Delayed Strike or lag. Most players however, are not aware of the importance of the hands ahead angle and the benefits of delayed strike. If a golfer instead tries to replicate the address position at the point of impact with the ball he will find that the hands will be behind the club face and the ball at the point of impact. This leads to their weight being on the back foot or centre of the stance, leading to a reduction in the power of the swing and bad body position. This leads to inconsistent ball striking, ball flight and ball direction.

A golf club face has a loft angle defined by a measurement in an apparatus known as a loft and lie device in which the shaft is locked into a vertical plane and where the club face is set with the leading edge of the clubface at 90 degrees to the target line. The sole of the club is arranged to sit midway between heel and toe and the loft angle is measured from the club face to the vertical. The club may have a design bounce angle measured as the angle of the lowest face of the flange or sole of the club back to the leading edge. The flange and the angle of the sole with respect the horizontal acts to avoid the leading edge of the club digging into the ground at impact.

With the Design Loft Angle known and the shaft in a vertical plane, then the Design Lean Angle or hands forward angle is the difference between, the actual angle between the club face and the vertical line, and the Design Loft Angle. This is illustrated in the accompanying drawings.

At impact, a player achieving optimum or close to optimum impact position will have necessarily shifted their weight and hands forward, in front of the ball at the address position. The shift and the hands forward angle that this creates will have the effect of reducing the loft angle of the club head design and reducing any bounce angle of the sole with respect to the sole horizontal at impact. This can mean impaired performance from the club and in some cases means that the leading edge of the club head and the planar striking face will come into contact with the ground before the flange or sole and dig in, resulting in a less effective shot.

An increase in the shaft angle creates a hands ahead angle for improved performance at impact and the increased bounce angle also assists in ensuring that the leading edge of the clubhead does not dig into the ground. This is suitable, for example, for an iron type club with a straight shaft known as a conforming club (a club conforming to the R&A rules of golf club construction).

Advantages of the golf club of the present invention include; that it forces the hands into the impact position during set up, therefore eliminating difficult hand/wrist/arm and body manoeuvres in the backswing and downswing to achieve the desired position at impact. The invention makes it very easy to have a one piece take away because the shaft and lead arm are in alignment with the centre of the club head arc (i.e. with the lead shoulder) and this is pre-set in the address position. The golf club simplifies the entire swing by eliminating the need to create a lag angle in the backswing and downswing. This also acts to engender a feeling that the player must utilise a lateral move with the hips towards the target to start the downswing. In addition the club ensures the player holds the hands off (ahead) the entire way through the impact zone. So casting and flipping/rolling the hands is not an option, if the player is to hit a straight shot. The club also promotes a good weight shift due to the lateral hip move in the direction of the target, this ensures the players hands are in the correct position at impact, promotes a full extension after impact and enables the player to swing to a balanced finish due to weight being firmly on the lead foot during the impact zone. Finally the golf club promotes a positive strike through the impact zone because the hands are ahead of the club head. This is especially pertinent in the short game (chipping, pitching and putting). This promotes a feeling of "swinging through the impact zone" not hitting at the ball.

Figure 1B:
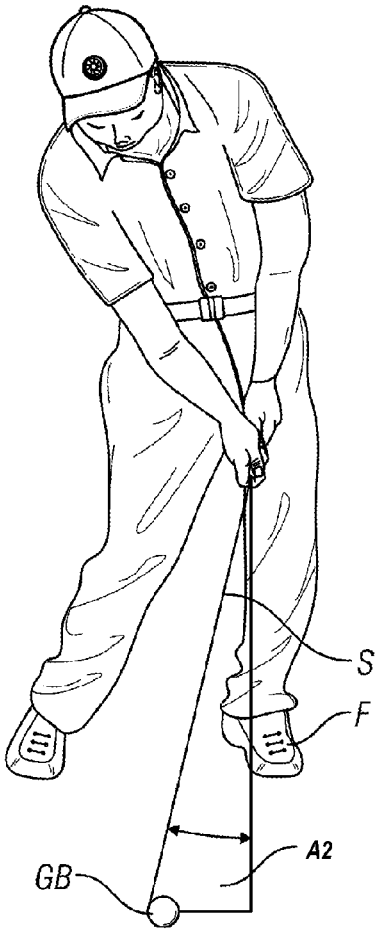
Figure 2A:
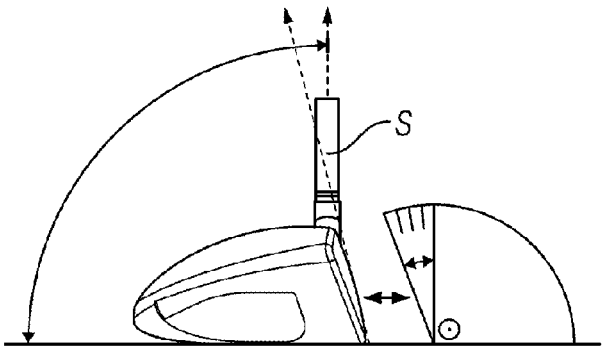
Figure 2B:
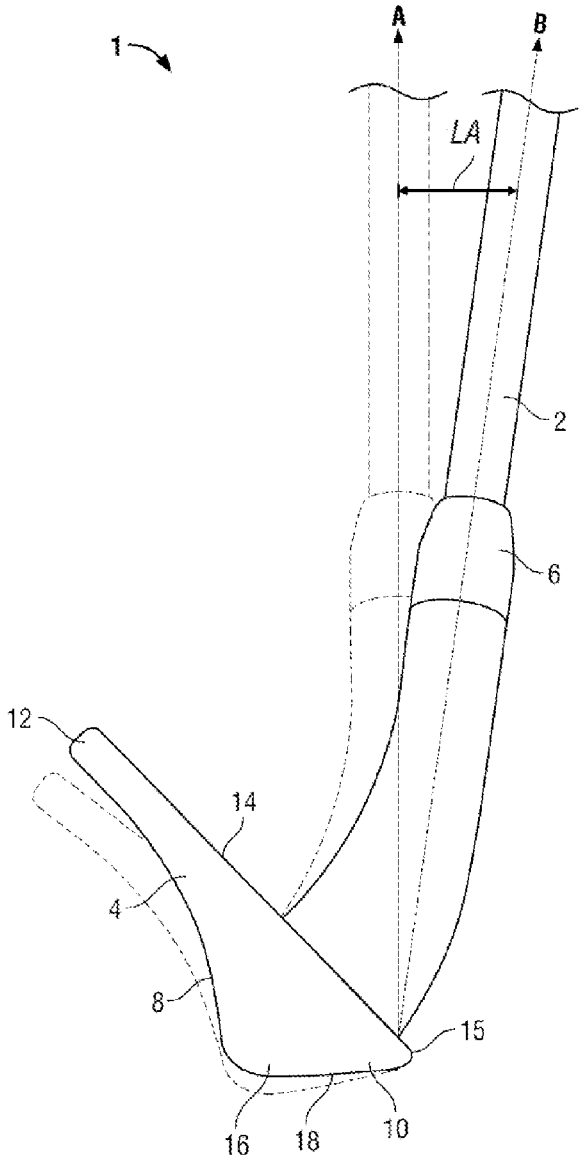
Figure 3A:
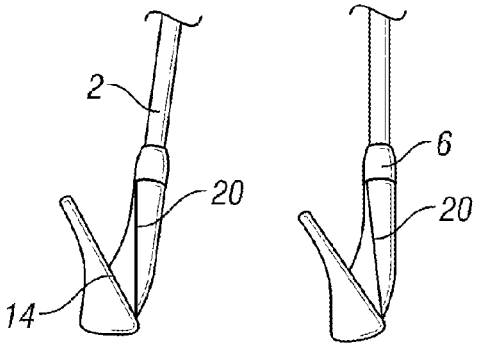
Figure 3B:
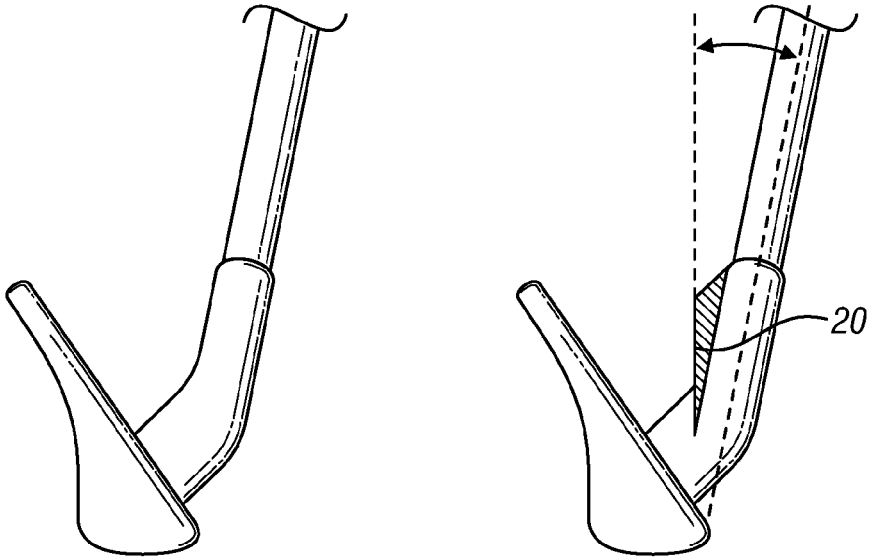
Figure 3C:
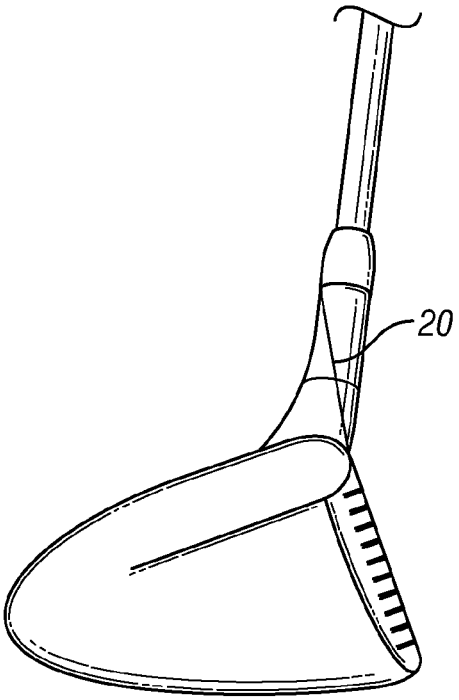
Figure 4A:
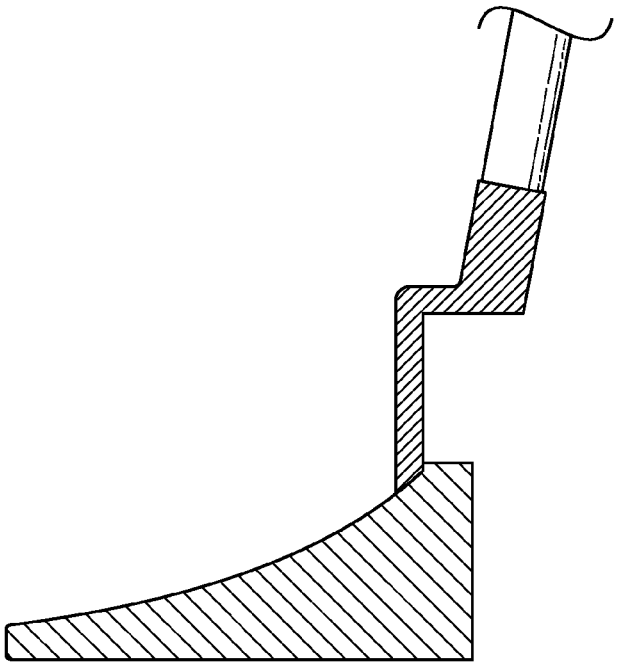
Figure 4B:
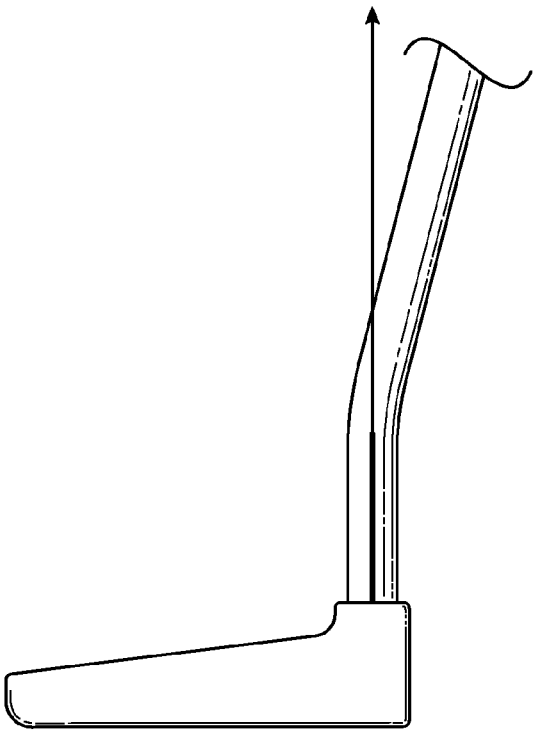
Figure 4C:
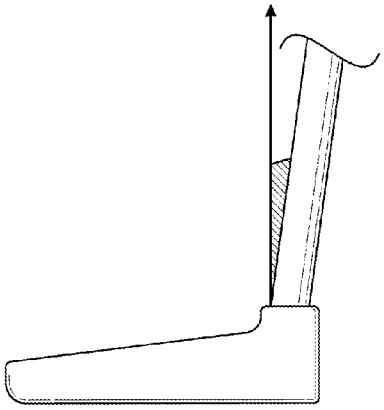
Figure 5A:
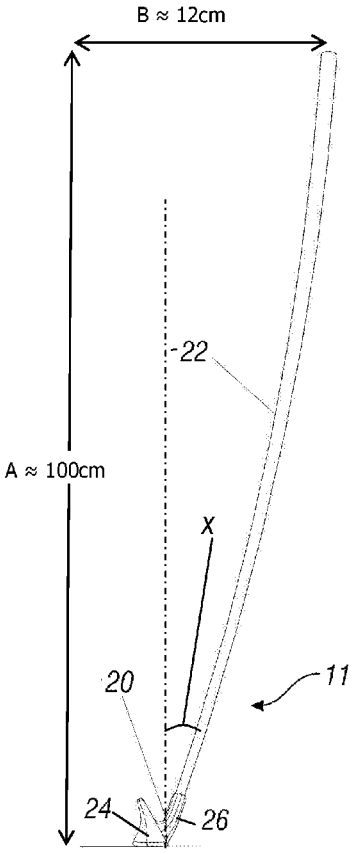
Figure 5B:
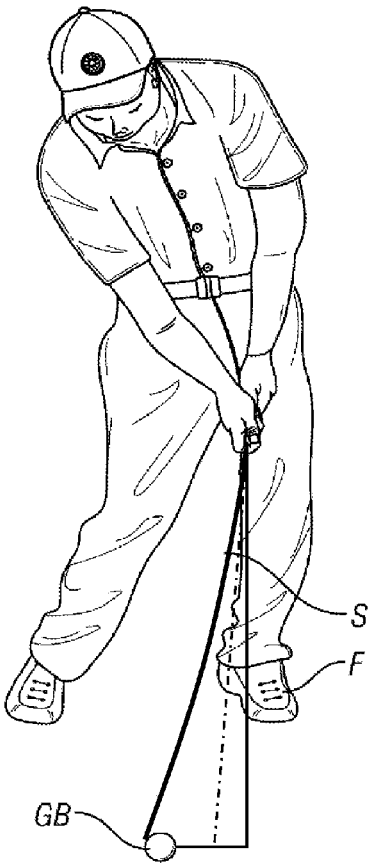

Embodiments of the invention will now be described in detail, by way of example only, with reference to the accompanying drawings, in which:

FIG. 1*a* is view of a player along the direction of the target line;

FIG. 1*b* is a diagram of a player at an optimum impact position, with hands ahead angle;

FIG. 2*a* is a conventional wood club head shown with a loft angle and a conventional loft and lie machine;

FIG. 2*b* is a golf club according to a first embodiment of the invention;

FIG. 3*a* shows a golf club with an alignment marking element according to an embodiment of the invention;

FIG. 3*b* shows an alternative golf club with an alignment marking element according to an embodiment of the invention;

FIG. 3*c* shows an alternative golf club with an alignment marking element according to an embodiment of the invention;

FIG. 4*a* shows a putter golf club with an alignment marking element according to an embodiment of the invention;

FIG. 4*b* shows an alternative putter golf club with an alignment marking element according to an embodiment of the invention;

FIG. 4*c* shows a further alternative putter golf club with an alignment marking element according to an embodiment of the invention;

FIG. 5*a* is schematic diagram of a training club of the invention according to a second embodiment of the invention; and, FIG. 5*b* is a diagram of a player at an optimum impact position, with hands ahead angle, the player using a training club comprising a curved shaft.

In all of FIGS. 2*b* to 4*c*, the golf club is orientated to strike the ball towards the right of the page.

The golf club of the present invention will now be described with reference to the accompanying drawings.

FIG. 1*a* shows a player as seen from along the target line for the shot. There are two orthogonal angles of the shaft of a golf club that must be optimised in order to obtain the optimal shaft orientation: (i) the lean angle of the shaft relative to the vertical axis in a direction perpendicular to the target; and (ii) the lean angle of the shaft relative to the vertical axis in a direction parallel to the target line. The first of these angles A1 is illustrated in FIG. 1*a*; the second of these angles A2 is illustrated in FIG. 1*b*.

FIG. 1*b* shows a player at the position of impact. The player's eyeline is behind the ball, GB, the player's weight is shown over the lead foot, F. The shaft of the golf club, represented as S is shown at a second angle A2 that provides a hands ahead position. In this optimal position, the butt end of the golf club is approximately 15 cm closer to the target, for example the hole, than the club head.

In FIG. 2*a* the loft angle of a golf club can be seen as measured in a loft and lie machine with the shaft, S, having a vertical axis and being the angle of the face to the vertical. FIG. 2*b* shows a golf club 1 comprising an elongated shaft 2, and a club head 4. The shaft 2, having a first end portion (not shown) and a second end portion; the first end portion having a grip; a club head 4 having: (i) a shaft connection member 6 positioned at one end portion of the club head 4 and having a distal end portion that is coupled with the second end portion of the shaft 2; (ii) a toe 8 that defines an opposite end portion of the club head 4; (iii) an edge region 10 that defines a bottom portion of the club head 4 that extends between the opposite ends of the club head 4; (iv) a top edge portion 12 that defines an upper portion of the club head 4 and extends between the opposite ends of the club head 4; (v) a face 14 having a peripheral edge defined by the opposite end portions, edge region 10 and top edge 12 of the club head 4; the face 14 of the club head 4 having a striking face that is positioned at an angle with respect to the shaft. The angle is known as the loft angle. A leading edge 15 is provided defining the bottom portion of the striking face. In FIG. 2*b* the shaft connection member 6 is a hosel and the angle of design loft shown is 45 degrees. The club head 4 further comprises a sole 16 having a lower face 18 oriented to extend downwardly and rearwardly from the plane of the striking face 14 and from the leading edge 15, wherein with the shaft in a vertical plane address position the sole is positioned at an angle with respect to a horizontal line perpendicular to the vertical plane address position at the leading edge in the range from 0 to 15 degrees. The shaft 2 further comprises a lean angle in the range of 5 to 10 degrees forward of the said vertical plane address position. In FIG.

2*b* the angle of design bounce is 5 degrees. In FIG. 2*b* the forward lean angle, LA, is 10 degrees.

It has been found that the optimum impact position for an iron type club is with a lean angle, or hands forward angle of around 7 to 10 degrees. This has been found to be when the butt end of the shaft is around 10 to 15 cm forward of the club face 14.

FIGS. 3*a* to 3*c* illustrate alignment marking elements of the invention. FIG. 3*a* shows a club head 4 connected to a shaft 2 at a hosel 6. The additional sole angle creates a forward lean angle which can be difficult for the player to optimise. An address marker 20 is located on the hosel 6, by milling, painting or other form of marking so that it is aligned with the player's eyeline when the clubhead sits on the ground. The player in set up and address observes the address marker line 20 and when it appears vertical and foreshortened the correct set up has been achieved. FIG. 3*b* illustrates a vertical address marker 20 created on a club with an offset hosel and FIG. 3*c* shows the address marker 20 on a metal wood type club.

The address marker 20 is important due to inconsistencies with the ground surface of play and unfamiliarity of the player with the hands forward position, as described below. The exact forward hand position (lean angle) is determined by the sole of the club when the club head sits on the ground. The club head invariably sits close to square to the ground, however, certain golf clubs incorporate a "bounce angle" on the sole of the club to prevent the leading edge digging into the ground (if the player presents the clubface at too steep an angle in the impact zone). The lean angle is easy to locate under laboratory type conditions when the club is locked into loft and lie machine. However, because golf clubs are designed to be used on grass, where the club head doesn't necessarily orientate to a position where the club head sits in the intended manner/position, (and because the clubs differ from conventional clubs where the player aligns the shaft directly under the eye line to achieve the correct conventional address position) It is necessary to incorporate a hand position alignment marking on the club head hosel to enable the player to identify and pre-set the hands in the exact hand position required. This hand position alignment line will be at very specific angles for differing clubs (metal woods, rescue type clubs, iron type clubs and putters). The angle/s of the hand position alignment marking change minutely between iron type clubs where the ball position is relatively constant and only varies due to the length of the club. Whereas the rescue type clubs and metal wood type clubs have a different angle of marking due to the ball position being further forward in the stance and those clubs being longer than iron type clubs.

The hand position alignment marking (address marker 20) enables the player to identify and locate the correct forward hand position for all of the differing clubs in relation to the conventional (and unchanged) optimum ball position for the selected club. This alignment address marker 20 will be painted, forged, cast or molded into the hosel 6 of the club head 4. The hand position alignment marking may be known as HPAM. The address marking should be located on the hosel or connecting member of the club head. This should be positioned on the connecting member in a fashion that an extension of the marking would extend and point to the leading edge of the clubface starting at the lowest point on the hosel or connection member directly above the leading edge of the clubface and heading up the connecting member in line with the player's eye line.

In a preferred embodiment the address marker is located between 5 and 20 degrees from the centreline of the hosel 6 at the bottom of the club to just above the leading edge of the clubface to the player's nose when viewed on a vertical plane. The address marker alignment line markings on the metal woods, rescue and the iron type clubs will be marked on the hosel of the club head. Due to the hosel of club heads being tubular the markings will be curved around the hosel but when viewed from the player's eye line the marking will be foreshortened and viewed as a straight line when the hands are in the correct hands forward position.

The angle of the address alignment marker (also known as HPAM) is to be measured backwards from the centreline of the shaft. The centre line of the shaft is chosen because the player's eye line is not always on a vertical plane above the ball position. The marking angle (the angle) is made up of two angles added together these angles are; the lean angle measured in degrees back from the centreline of the shaft to the vertical plane and then the vertical plane backwards to the players eye line when the player is using various different clubs.

In a preferred embodiment of a putter illustrated in FIGS. 4*a* to 4*c*, the address marker 20 may form part of the club head. In putting the players' eyes should be located directly (vertically) above the ball, this means the marker 20 may form part of the club head which will be positioned vertically once the sole of the club sits squarely on the ground, before the hosel joins to the shaft and is leant forward at the preferred lean angle of between 6 and 8.5 degrees.

An alternative embodiment provides a training club comprising a curved shaft. FIG. 5*a* is schematic diagram and example of the training club 11 of the invention. The club 11 comprises a curved shaft 22, a club head 24, a first end portion having a grip 21; a club head 24 having: (i) a shaft connection member 26, a hosel, positioned at one end portion of the club head 24 and having a distal end portion that is coupled with the second end portion of the shaft 22. There is provided an address marker (not shown) on the club head hosel and added sole angle on the sole of the club 11. The club 11 is of tubular construction, in stainless steel or graphite. The curvature is such so as to provide curvature for a hands ahead position, the length of the club 11 will necessarily vary according to the training requirements and size of men, women and children. An example of construction figures are provided in FIG. 5 where A is the length of a standard men's 3 iron golf club. B is the horizontal distance from the top of the shaft when the club is held on a vertical plane to the top of the shaft at address with the hands forward when the club head sits squarely on the ground. Angle X is the angle between the vertical line drawn from the leading edge of the club head to the centreline of the tangent of the hosel, this hosel lean angle will vary between 11 and 25 degrees. The "club" denotes the curved shaft of the delayed strike iron. With the training club as described it is not possible to revert to the vertical address position (whereas with a straight shaft you could ignore the hands forward and address marker and bounce and revert to the "wrong" address position). Furthermore with the curved shaft it is almost impossible to strike the ball unless the hands are ahead of the leading edge of the club head. It is not straightforward to lock and fix a curved shaft training club within a loft and lie machine so the angle and position of the address marker is set and measured as back from the centre line of the hosel or other shaft connection member of the training club. The alignment marking angle will be specific to each club and will vary with a range of angles from 10 degrees to 25 degrees when measured back from the centreline of the shaft i.e. −10 degrees to −25 degrees.

FIG. 5*b* shows a player at the position of impact when using the training club illustrated in FIG. 5*a*. The player's eyeline is behind the ball, GB, the player's weight is shown over the lead foot, F. In this optimal position, similarly to a straight club, the butt end of the golf club is approximately 15 cm closer to the target, for example the hole, than the club face. An extension of the elongate axis of the shaft proximal to the grip-end of the club is illustrated in dash. As can be seen from the figure, this extension points to a position approximately 10 cm closer to the target than the club face. Various modifications may be made to the described embodiments without departing from the scope of the present invention. The club and head may comprise any suitable material. The club may be of varying lengths and thickness, the hands forward angle may be achieved with a straight shaft, a shaft comprising a series of bends or a curved shaft. The address marker may be located on the top face of an appropriate club such as a wood or a rescue type club. The address marker may be a full solid line or may be dashed or comprise a marker at an upper and a lower extent of the line only. The putter of the invention may have any standard industry construction or method of connection between the shaft and the head, for example answer style, or toe weighted mallet style. The sole of the club may have a bounce angle. Alternative forms of construction of the club and material types for the club may be considered.

The invention claimed is:

1. A golf club comprising:

an elongate shaft having a grip at a first longitudinal end thereof;

a club head coupled to a second longitudinal end of the elongate shaft, the club head comprising a sole and a ball striking face, the sole is oriented relative to the shaft, wherein with the shaft in a vertical plane address position, the sole is positioned at an angle with respect to a horizontal line perpendicular to the vertical plane address position; and an elongate marker comprising a longitudinal axis orientated such that, when the sole of the golf club lies substantially parallel to a first plane of the ground, the longitudinal axis of the elongate marker extends in a second plane defined by a first vector in a direction substantially perpendicular to the first plane of the ground and a second vector substantially parallel to a normal of the face of the club head, wherein the club head is coupled to the second longitudinal end of the elongate shaft by a connection portion of the club head, wherein the elongate marker is located at least partially on the connection portion and located on an uppermost surface of the club head so that the elongate marker appears to a user as a straight line parallel to the first plane of the ground when the golf club is inclined forward from the first vector within said second plane, and wherein the longitudinal axis of the elongate marker is arranged to extend in a direction substantially parallel to the first vector when the angle of the forwardly-inclined golf club shaft is within said second plane and such that the angle of the forwardly-inclined golf club shaft relative to the first vector is between approximately 3 degrees and approximately 30 degrees.

2. The golf club as claimed in claim 1, wherein the elongate shaft of the golf club is at an angle that is between 3 and 30 degrees to said second plane when the longitudinal axis of the elongate marker lies in said second plane.

3. The golf club as claimed in claim 1, wherein the elongate marker is orientated such that, when the sole of the golf club lies substantially parallel to the first plane of the ground, the longitudinal axis of the elongate marker is substantially parallel to a line of sight.

4. The golf club as claimed in claim 1, wherein the longitudinal axis of the elongate marker is arranged to extend in a direction substantially parallel to the first vector when the angle of the shaft within said second plane and relative to the first vector is between approximately 3 degrees and approximately 30 degrees.

5. The golf club as claimed in claim 1, wherein the ball striking face comprises a leading edge and a trailing edge, defined in terms of a direction of swing of the golf club, the longitudinal axis of the elongate marker being directed towards a leading edge of the ball striking face.

6. The golf club as claimed in claim 1, wherein the ball striking face is positioned with respect to the elongate shaft at an angle of between 0 degrees to 65 degrees.

7. The golf club as claimed in claim 1, wherein the elongate marker comprises a mark that is painted, forged, milled, cast, scored, dyed or molded on the uppermost surface of the golf club.

8. The golf club as claimed in claim 1, wherein the golf head comprises a sole angle of at least 3 to 30 degrees, when measurement of the sole angle is taken whilst centerline of the elongate shaft is in said second plane.

9. The golf club according to claim 1, wherein the golf club is a training club comprising a curved shaft as the elongate shaft.

10. The golf club according to claim 9, wherein the curved shaft is configured to curve outwardly away from a direction of the target when in use.

11. A method for modifying a golf club to assist in training, the method comprising:

providing a golf club with a grip on a first longitudinal end of an elongate shaft comprising a club head coupled to a second longitudinal end of the elongate shaft, the club head comprising a sole and a substantially planar face, the sole is oriented relative to the elongate shaft, wherein with the elongated shaft in a vertical plane address position, the sole is positioned at an angle with respect to a horizontal line perpendicular to the vertical plane address position;

aligning the sole of the golf club with a first plane; and marking the golf club with an elongate marker having a longitudinal axis in a second plane comprising a first vector in a direction substantially perpendicular to the first plane of the ground and a second vector substantially parallel to the normal of the planar face of the club head, and wherein the longitudinal axis of the elongate marker is arranged to extend in a direction substantially parallel to the first vector when the angle of the forwardly-inclined golf club shaft is within said second plane and such that the angle of the forwardly-inclined golf club shaft relative to the first vector is between approximately 3 degrees and approximately 30 degrees.

12. The method as claimed in claim 11, wherein marking step comprises marking a connection portion of the club head coupling the second longitudinal end of the elongate shaft with the club head.

13. The method as claimed in claim 11, wherein:

the method further comprises identifying a line of sight of a player standing on said first plane and holding the club such that the sole is aligned with the first face; and wherein the marking step comprises marking the golf club with the elongate marker having the longitudinal axis substantially parallel to the line of sight of the player to the head of the golf club when in an optimal address position.

14. A golf club comprising:

an elongate shaft having a grip at a first longitudinal end of the elongate shaft;

a club head coupled to a second longitudinal end of the elongate shaft via a connection portion of the club head, the club head comprising a sole and a ball striking face defining a first plane, the sole is oriented relative to the elongate shaft, wherein with the elongated shaft in a vertical plane address position, the sole is positioned at an angle with respect to a horizontal line perpendicular to the vertical plane address position; and an elongate marker comprising a longitudinal axis orientated such that, when the sole of the golf club lies substantially parallel to a ground plane, the longitudinal axis of the elongate marker extends in a second plane, wherein the second plane is defined by a first vector perpendicular to the ground plane and a second vector substantially parallel to a normal of the ball striking face of the club head, wherein the elongate marker is located at least partially on the connection portion and located on an uppermost surface of the club head so that the second plane defines a line of sight of a player when the elongate shaft of the golf club is inclined to an optimal position, and wherein the longitudinal axis of the elongate marker is arranged to extend in a direction substantially parallel to the first vector when the angle of the forwardly-inclined golf club shaft is within said second plane and such that the angle of the forwardly-inclined golf club shaft relative to the first vector is between approximately 3 degrees and approximately 30 degrees.

* * * * *